US006932095B1

(12) United States Patent
Hanson et al.

(10) Patent No.: US 6,932,095 B1
(45) Date of Patent: Aug. 23, 2005

(54) CRUTCH SUPPORT SYSTEM

(76) Inventors: Chaon Hanson, 209 Mooregate Trail, Hawthorn Woods, IL (US) 60047-7709; Scott Hanson, 209 Mooregate Trail, Hawthorn Woods, IL (US) 60047-7709

( * ) Notice: Subject to any disclaimer, the term of this patent is extended or adjusted under 35 U.S.C. 154(b) by 45 days.

(21) Appl. No.: 10/811,731

(22) Filed: Mar. 29, 2004

(51) Int. Cl.[7] ..... A45B 3/00; A45B 5/00; A47C 4/02; A61H 3/02

(52) U.S. Cl. ..... 135/66; 135/68; 280/812; 297/217.1

(58) Field of Search ..... 135/66, 68; 280/812; 297/217.1, 118, 129

(56) References Cited

U.S. PATENT DOCUMENTS

| | | | | | |
|---|---|---|---|---|---|
| 1,089,295 | A * | 3/1914 | Vallier | 248/155.1 |
| 3,874,687 | A * | 4/1975 | Cadwalader | 280/812 |
| 4,062,372 | A * | 12/1977 | Slusher | 135/66 |
| 4,793,370 | A * | 12/1988 | Perez et al. | 135/69 |
| 5,010,850 | A * | 4/1991 | Sailer | 297/129 |
| 5,313,971 | A * | 5/1994 | Upshaw | 135/68 |
| 6,192,908 | B1 * | 2/2001 | Smith | 135/66 |
| 6,257,258 | B1 * | 7/2001 | Smith | 135/66 |
| 6,263,892 | B1 * | 7/2001 | Baker | 135/66 |
| 6,397,868 | B1 * | 6/2002 | Smith | 135/66 |
| 6,651,684 | B2 * | 11/2003 | Spitzer | 135/78 |
| 2004/0069336 | A1 * | 4/2004 | Marek | 135/68 |

FOREIGN PATENT DOCUMENTS

| | | | | |
|---|---|---|---|---|
| JP | 2004-33447 | * | 2/2001 | A61H 3/02 |
| JP | 2002-113058 | * | 4/2002 | A61H 3/02 |
| JP | 2003111807 | * | 4/2003 | A61H 3/02 |

* cited by examiner

*Primary Examiner*—Robert Canfield
(74) *Attorney, Agent, or Firm*—Cardinal Law Group

(57) ABSTRACT

A crutch support system including a pair of crutches is disclosed. Each crutch includes a pair of support shafts. Each support shaft includes a plurality of hand grip adjustment holes and a seat support pin received in hand grip adjustment holes in each support shaft pair. A seat is releasably connected to the seat support pins.

9 Claims, 3 Drawing Sheets

600

CRUTCH SUPPORT SYSTEM

FIELD OF THE INVENTION

This invention generally relates to the art of crutches and more specifically, to a crutch support system.

BACKGROUND OF THE INVENTION

Persons suffering from injured lower limbs are frequently required to use crutches for mobility. However, crutches require more energy from the user than merely walking, and frequently, a crutch user may require rest. Prior crutch systems have not provided a convenient way to provide the user with such rest.

The present invention advances the art.

BRIEF SUMMARY OF THE INVENTION

One aspect of the invention is a crutch support system including a pair of crutches, each crutch including a pair of support shafts. Each support shaft includes a plurality of hand grip adjustment holes. A seat support pin is received in hand grip adjustment holes in each support shaft pair; and a seat is releasably connected to the seat support pins.

Another aspect of the invention is a method of forming a crutch support. The method includes the steps of attaching a seat between a crutch pair, positioning base portions of a crutch pair within a support region, and deploying kick stands attached to the crutch pair.

Yet another aspect of the invention provides a crutch support system including a crutch pair, means for attaching a seat to the crutch pair; and a seat attached to the attaching means.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION

Figure 1:
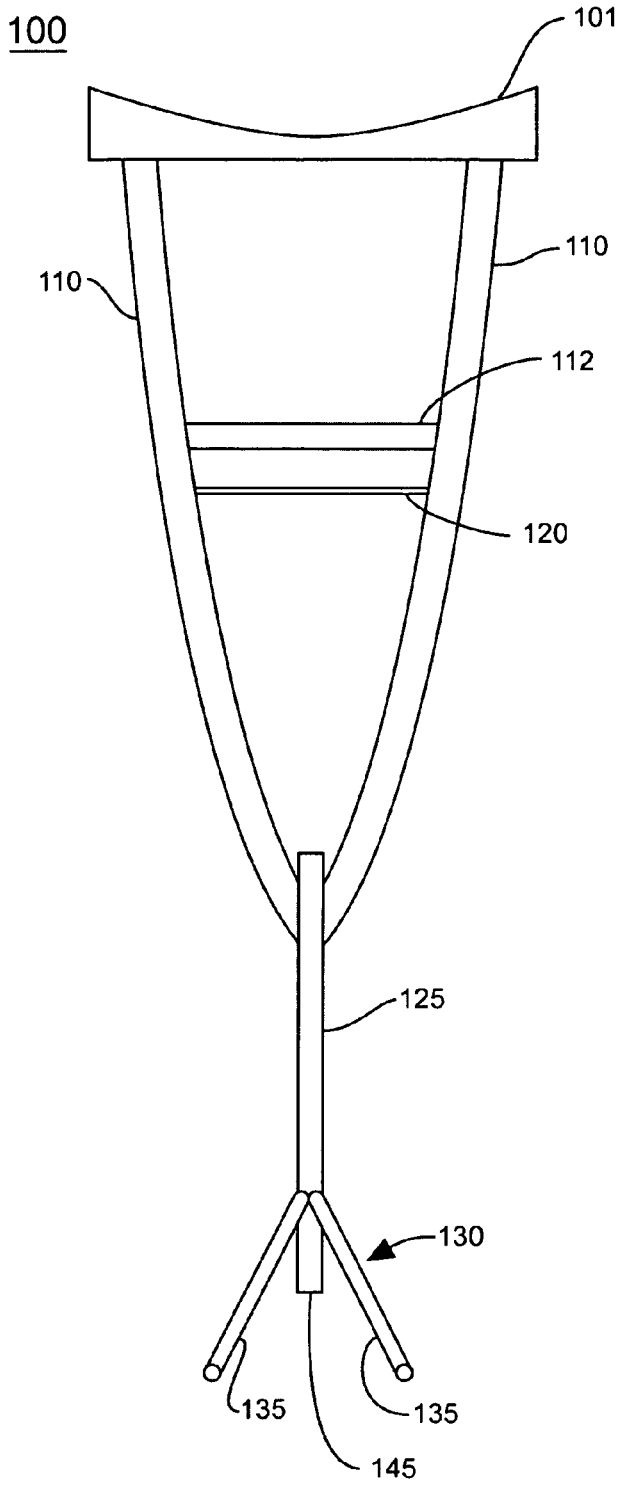
FIG. 1 illustrates one embodiment of a crutch support system in accordance with one aspect of the invention.

FIG. 1 illustrates one embodiment of a crutch 100 used in a crutch support system in accordance with one aspect of the invention. Crutch 100 includes a pad portion 101, a pair of support shafts 110, and a base portion 125. In one embodiment, support shafts 110 and base portion 125 are adjustably connected with a pin. In another embodiment, support shafts 110 and base portion 125 are fixedly connected, using any appropriate method such as welding. Alternatively, support shafts 110 and base portion 125 may be constructed as a unitary piece. Base portion 125 includes contact portion 145.

Figure 2:
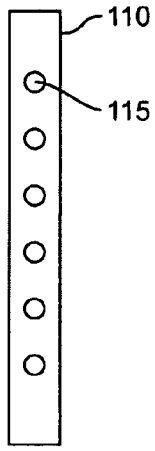
FIG. 2 illustrates one embodiment of a crutch support system in accordance with one aspect of the invention.

Support shafts 110 each include a plurality of hand grip adjustment holes 115, as best illustrated in FIG. 2. In one embodiment, hand grip adjustment holes 115 are configured to be in alignment with hand grip adjustment holes 115 of the second support shaft 110. Pad portion 101 spans the distance between support shafts 110 at an upper portion of each support shaft 110. The distance between the support shafts 110 is also spanned by hand grip 112. In one embodiment, hand grip 112 is a padded grip.

Hand grip 112 is configured for insertion in hand grip adjustment holes 115. In one embodiment, hand grip 112 is configured for adjustable insertion, using for example, wing nuts to facilitate moving the hand grip 112 up or down the length of the shaft to vary the distance between pad portion 101 and the hand grip 112.

Seat support pin 120 spans the distance between support shafts 110. Seat support pin 120 is configured for adjustable insertion into hand grip adjustment holes 115. In one embodiment, seat support pin 120 is removably inserted into hand grip adjustment holes 115 and attaches to support shaft 110 using removable connection means. The removable connection means may comprise a threaded end of the seat support pin 120 configured to mate with a wing nut. Seat support pin 120 comprises any appropriate material configured to provide sufficient strength. For example, seat support pin 120 may comprise a metal, such as steel, a composite or any combination thereof. In one embodiment, seat support pin 120 is substantially cylindrical. In another embodiment, seat support pin 120 has a polygonal configuration. In other embodiments, seat support pin 120 is any device configured to lockably and adjustably attach to support shafts 110 and support seat 550 (FIG. 5).

Figure 4A:
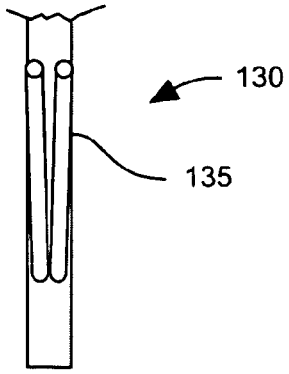
FIGS. 4A and 4B illustrate one embodiment of a crutch support system in accordance with one aspect of the invention.
Figure 4B:
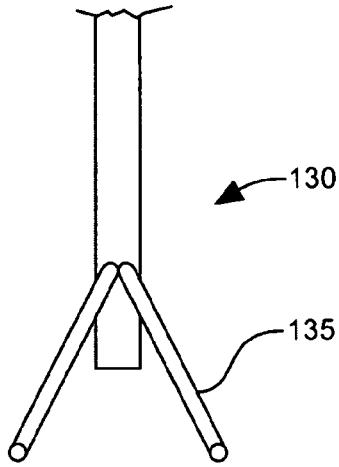

In one embodiment, a kickstand 130 is attached to base portion 125. Kickstand 130 includes at least one collapsible support member 135. In one embodiment, kickstand 130 includes two collapsible support members 135. Kickstand 130 is configured to provide support to base portion 125, and thus to the remaining elements of crutch 100. Kickstand 130 is configured to provide for an open, or deployed, configuration wherein each collapsible support member 135 extends out from base portion 125 in such fashion as to contact a support surface such as a floor or ground on the same geometric plane as the other collapsible support member 135 and contact portion 145. Kickstand 130 is further configured to provide for a closed, or undeployed, configuration wherein each collapsible support member 135 does not contact a support surface. In one embodiment, the closed configuration is such that an axis of the collapsible support member 135 is substantially parallel with an axis of the base portion 125. In one embodiment, the open configuration provides that the axis of the collapsible support member 135 is not substantially parallel with an axis of base portion 125 such that an angle is created between the relative axes. Each collapsible support member 135 is rotatably attached so as to allow rotation between the open and closed configurations. Rotating the collapsible support members 135 to the open configuration is also termed deploying the kickstands. FIG. 4A depicts collapsible support members 135 in a closed configuration, while FIG. 4B depicts the collapsible support members 135 in an open configuration. Contact portion 145 comprises a non-slip substance, such as rubber, in certain embodiments. In other embodiments, a bottom of each collapsible support member 135 includes a non-slip substance, such as rubber. In one embodiment, kickstand 300 attaches to the crutch at a hole for adjusting the connection between the support shafts 110 and the base portion 125. In another embodiment, kickstand 300 is affixed to the base portion 125 by any appropriate method, such as welding. In another embodiment, kickstand 300 is constructed integrally with one of the base portion 125 and support shaft 110.

Figure 3A:
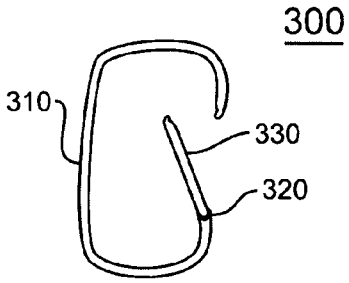
FIGS. 3A and 3B illustrate one embodiment of a crutch support system in accordance with one aspect of the invention.
Figure 3B:
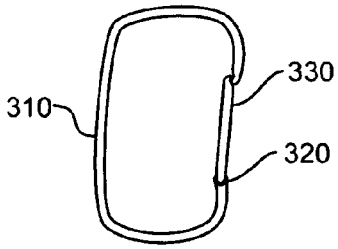

FIGS. 3A and 3B depict a support clip 300 configured to attach to seat support pin 120. In one embodiment, support clip 300 comprises a carabineer clip. Support clip 300 includes support portion 310, hinge 320 and leg 330. Hinge 320 biases leg 330 into contact with support portion 310 such that a substantially continuous loop is created. In one embodiment, leg 330 is configured to hingedly rotate about hinge 320 toward support portion 310, but not rotate away. FIG. 3A depicts the support clip 300 in an open configuration and FIG. 3B depicts the clip 300 in a closed configuration. Use of a support clip 300 allows for releasable attachment to seat support pin 120.

Figure 5:
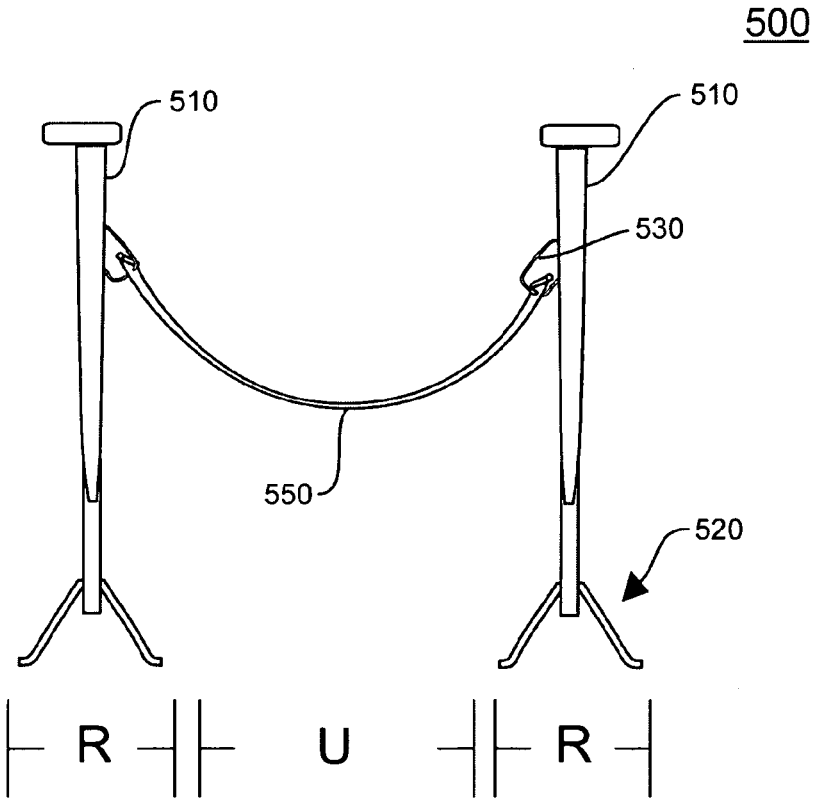
FIG. 5 illustrates one embodiment of a crutch support system in accordance with one aspect of the invention.

FIG. 5 illustrates a crutch support system 500 in accordance with one aspect of the invention. Crutch support system 500 includes a pair of crutches 510. In one embodiment, each crutch 510 is crutch 100 as described with reference to FIG. 1. Crutch support system 500 further includes a support clip 530, implemented as a clip 300 described above with reference to FIGS. 3A, 3B. Support clip 530 attaches to a seat support pin of each crutch 510 and provides support to seat 550. The seat is releasably connected to the seat support pins through support clip 530. Kickstand 520 is attached to a base portion of each crutch 510.

Seat 550 may be any appropriate seat. In one embodiment, seat 550 is a flexible seat. For example, seat 550 may be implemented as a swing seat commonly used on playground swing sets. Seat 550 may comprise a canvas material, rubber material or a cloth material. When not in use, seat 550 may remain attached to one crutch, or may be carried separately from the crutch.

In use, each crutch 510 is placed in a support region "r" wherein "r" is a region outside of a user region "u" wherein a user of the crutch system is seated on the crutch system.

Figure 6:
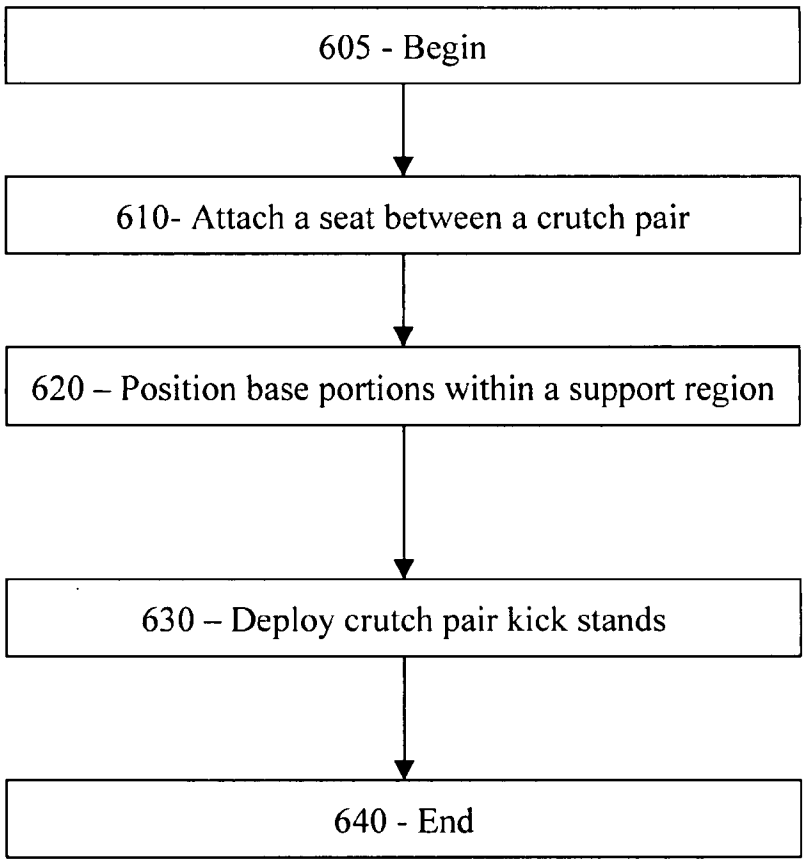
FIG. 6 illustrates one embodiment of a method of forming a crutch support in accordance with one aspect of the invention.

FIG. 6 illustrates a flow chart depicting a method 600 of forming a crutch support in accordance with another aspect of the invention. Method 600 begins at step 605. At step 610, a seat is attached between a crutch pair. The seat may be attached with removable means, such as clip 300 depicted in FIGS. 3A, 3B. Attaching the seat may also comprise clipping a clip member to a support pin spanning hand grip adjustment holes.

At step 620, the base portions of the crutch pair are positioned within a support region, such as support region "r" of FIG. 5. At step 630, crutch kickstands are deployed. At step 640, method 600 ends.

Other embodiments of the invention include crutch systems with substantially infinitely adjustable seat support pin 120, such that seat support pin 120 is configured to slide along the shaft 110. In one such example, hand grip adjustment holes 115 may comprise a plurality of locking teeth, or ratchet teeth, to lockably and adjustably support seat support pin 120. A number of adjustable connection means will readily occur to those of skill in the art, and are considered the equivalents of the invention claimed herein.

As used herein, the term "kickstand" is defined as any support system that is configurable to a deployed position and an undeployed position, wherein the deployed position provides support to the crutch system.

The present invention may be embodied in other specific forms without departing from its spirit or essential characteristics. The described embodiments are to be considered in all respects only as illustrative and not restrictive.

What is claimed is:

1. A crutch support system comprising:

a pair of crutches, each crutch including a pair of support shafts, each support shaft including a plurality of hand grip adjustment holes;

a seat support pin received in hand grip adjustment holes in each support shaft pair; and a seat releasably connected to the seat support pins.

2. The crutch support system of claim 1 wherein each crutch includes a kickstand attached to a base portion of the crutch.

3. The crutch support system of claim 2 wherein the kickstand includes two collapsible support members.

4. The crutch support system of claim 1 wherein the seat attaches to the support pins with support clips.

5. The crutch support system of claim 4 wherein the support clips comprise carabineer clips.

6. The crutch support system of claim 1 wherein the seat is flexible.

7. A method of forming a crutch support, the method comprising:

attaching a seat between a crutch pair;

positioning base portions of a crutch pair within a support region; and deploying kick stands attached to the crutch pair, wherein attaching the seat to the crutch pair comprises clipping a clip member to a support pin spanning hand grip adjustment holes.

8. The method of claim 7 wherein the support region comprises a region outward of a shoulder width of a user.

9. The method of claim 7 wherein deploying the kickstands comprises rotating the kick stands from a closed position to an open position.

* * * * *